US006224458B1

(12) United States Patent
Chen

(10) Patent No.: US 6,224,458 B1
(45) Date of Patent: May 1, 2001

(54) BREAST PAD STRUCTURE

(76) Inventor: Chin-Tang Chen, 5F, No. 26, Jin Hua St., Taipei (TW)

( * ) Notice: Subject to any disclaimer, the term of this patent is extended or adjusted under 35 U.S.C. 154(b) by 0 days.

(21) Appl. No.: 09/475,138

(22) Filed: Dec. 30, 1999

(51) Int. Cl.[7] ..... A41C 3/00
(52) U.S. Cl. ..... 450/57; 450/38
(58) Field of Search ..... 450/57, 38, 39, 450/53–56, 40, 41, 58, 30–32; 2/267, 268; 623/7, 8

(56) References Cited

U.S. PATENT DOCUMENTS 3,278,947 * 10/1966 Silverman ..... 623/7
3,304,558 * 2/1967 Mann ..... 450/57
3,494,365 * 2/1970 Beals ..... 623/7
4,125,117 * 11/1978 Lee ..... 450/57
5,098,330 * 3/1992 Greenberg ..... 450/55

* cited by examiner

*Primary Examiner*—Gloria M. Hale
(74) *Attorney, Agent, or Firm*—Bacon & Thomas

(57) ABSTRACT

An improved breast pad structure includes a forming cup and a stuffed pressure-resistant bag. The forming cup has a shell shape curving inwardly in a single direction, and is internally provided with a receiving space. The stuffed pressure-resistant bag is a sealed and tough sac containing therein a fluid or semi-fluid filling of a suitable amount and positioned in the receiving space of the forming cup. The stuffed pressure-resistant bag can, by means of the support of the forming cup, forms a contoured breast pad and, after formation, constitutes a supporting portion. The supporting portion can resist deformation, damage and has a real feel, and that can prolong useful life and effectively help make the user's breasts comfortable and look beautiful and firm.

6 Claims, 7 Drawing Sheets

BREAST PAD STRUCTURE

BACKGROUND OF THE INVENTION (a) Field of the Invention

The present invention relates generally to an improved breast pad structure, more particularly to a breast pad structure that is simple in construction, that is easy to manufacture, that is not vulnerable to deformation or damage, that has a supporting portion giving a real feel, and that has a forming cup to provide a nice contour to the wearer's breasts.

(b) Description of the Prior Art

In the past, brassieres are mainly used to support and cover the wearer's breasts. Nowadays, there are various types of brassieres designed to shape and massage breasts or make the breasts look voluptuous and firm, etc. These functions of the brassieres are mostly attributed to the provision of specially configured breast pads in the brassieres. There are, however, the following drawbacks with conventional breast pads:

1. Breast pads of sponge, although easier to form, are too soft and cannot therefore provide the desired support. Less soft sponge, however, does not provide good elasticity and can easily be deformed after use. In particular, sponge material may age and become flattened after washing and drying. Short useful life is a serious problem.
2. For silicon breast pads, although they have toughness and good elasticity, they are comparatively heavy and difficult to process. Besides, the material cost is high.
3. As for breast pads in the form of sacs formed from a plastic film and containing a filling liquid, gas or paste-like substance, although they can give a realistic feel and has a good effect, since the fluid in the sac is freely flowing, the shape cannot be fixed to form a breast pad of nice contour.

SUMMARY OF THE INVENTION

A primary object of the present invention is to provide an improved breast pad structure that, in addition to having a nice feel and being easy to manufacture, has a support portion that is not vulnerable to deformation or damage and that gives a realistic feel, and has a forming cup that gives the breast pad a nice contour.

In order to achieve the above-mentioned object, an improved breast pad structure of the present invention includes a forming cup and a stuffed pressure-resistant bag. The forming cup has a shell shape curving inwardly in a single direction, and is internally provided with a receiving space. The stuffed pressure-resistant bag is a sealed and tough sac containing therein a fluid or semi-fluid filling of a suitable amount and positioned in the receiving space of the forming cup. The stuffed pressure-resistant bag can, by means of the support of the forming cup, forms a contoured breast pad and, after formation, constitutes a supporting portion. The supporting portion can resist deformation, damage and has a real feel, and that can prolong useful life and effectively help make the user's breasts comfortable and look beautiful and firm.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
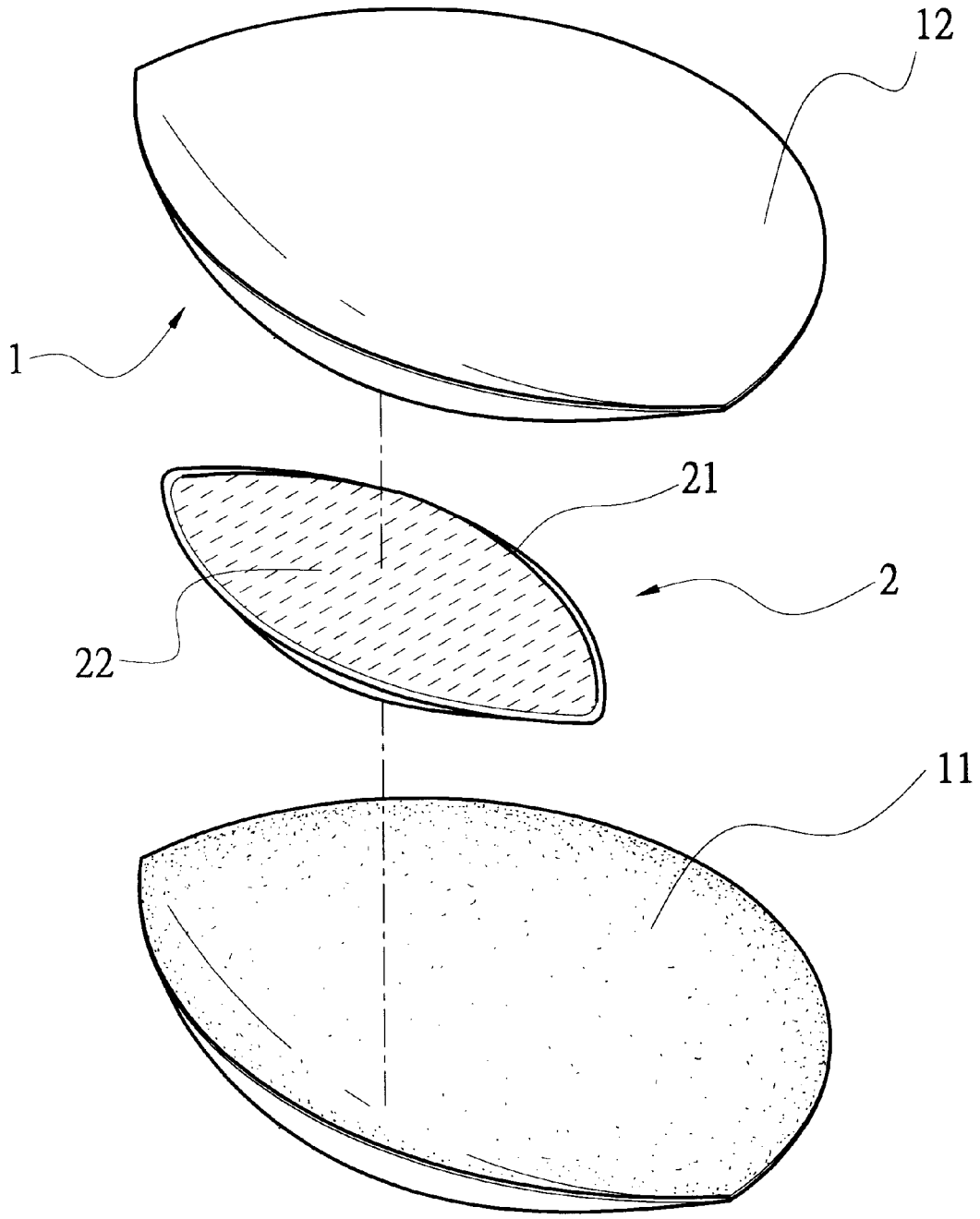
FIG. 1 is an exploded perspective view of the present invention.
Figure 2:
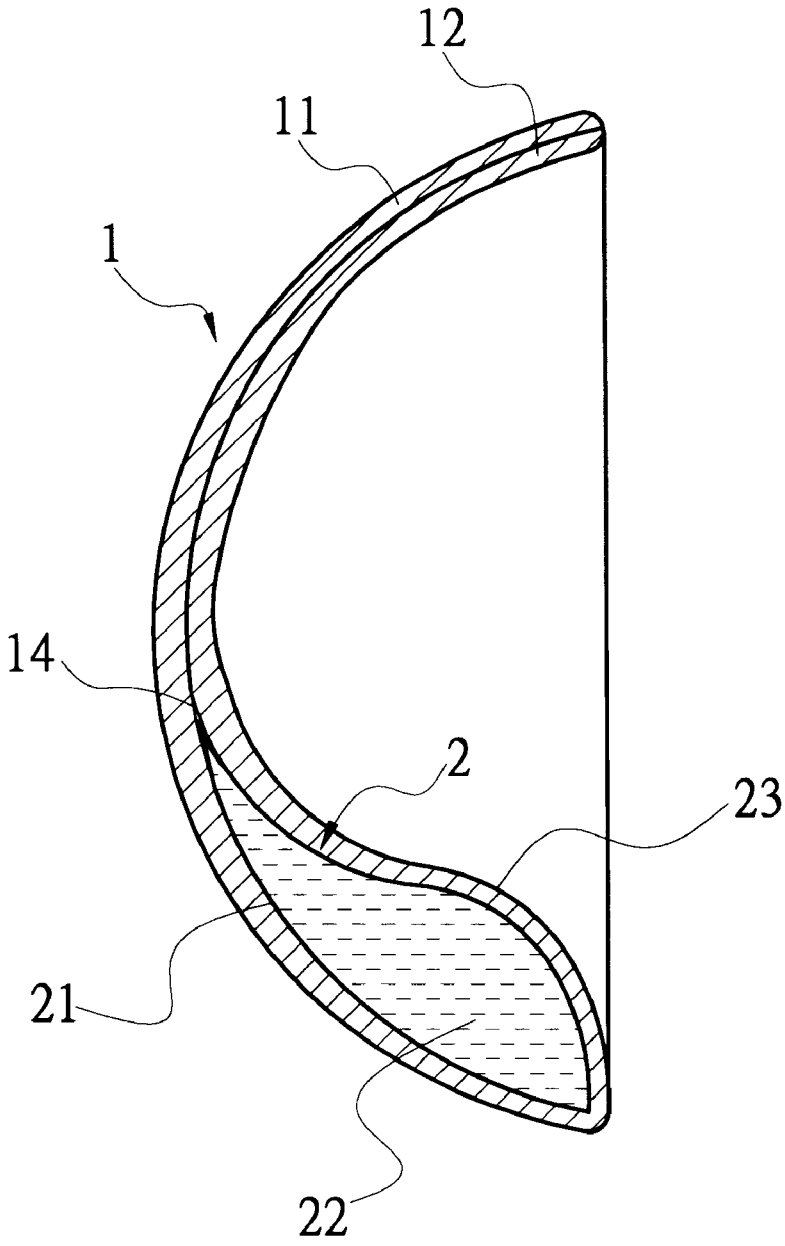
FIG. 2 is an assembled plan view of the present invention.
Figure 3:
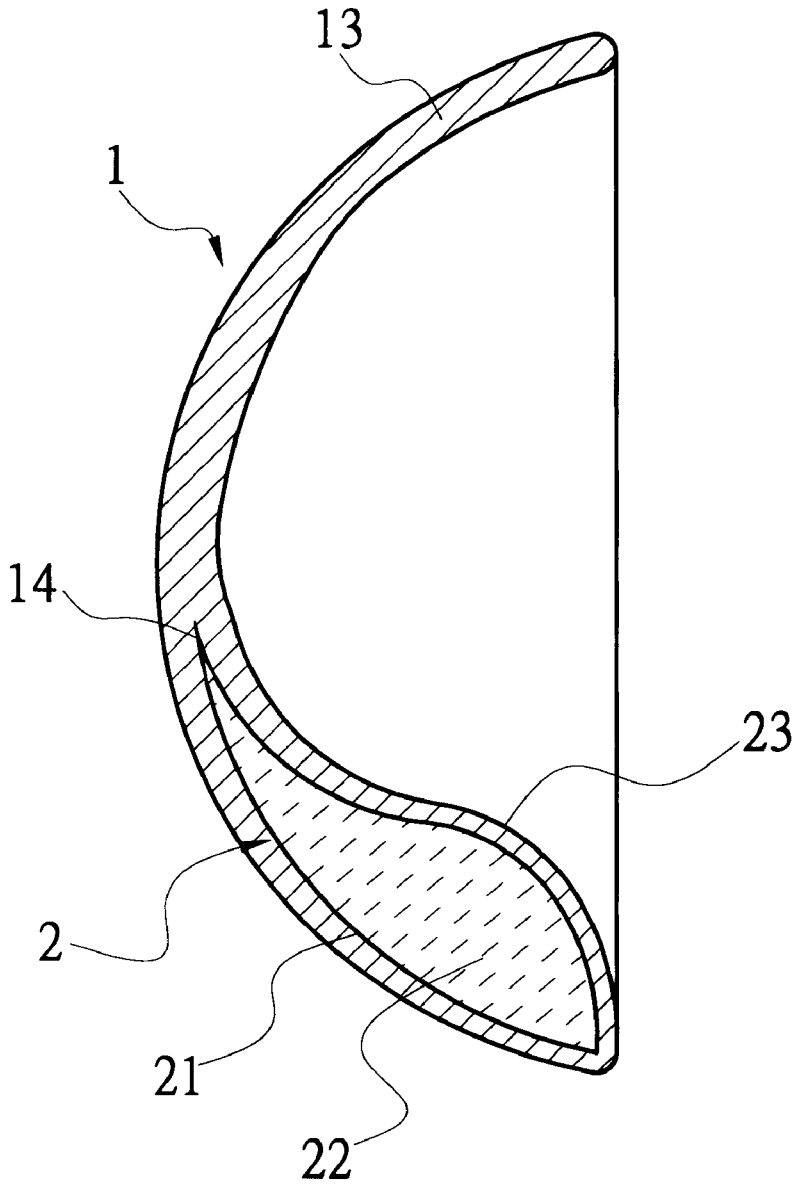
FIG. 3 is an assembled plan view of an integrally formed forming cup of the present invention.

As shown in FIGS. 1 and 2, an improved breast pad according to the present invention includes an outer forming cup 1, and an embedded stuffed pressure-resistance bag 2.

The forming cup 1 generally has a shell shape that curves inwardly in a single direction. The shell shape may include two concave foamed bodies 11, 12 that curve in the same direction, and that are connected as a whole, or one integrally formed foamed body 13. The foamed body may be formed from PU foam material or silk cotton. The forming cup 1 is internally provided with a receiving space 14.

The stuffed pressure-resistant bag 2 is a sealed and tough sac 21 containing a suitable amount of filling 22 that is a fluid or semi-fluid that can flow freely in the sac 21. The filling 22 can be a liquid, a gas, or a paste like substance.

As the present invention is simple in construction, upon forming the plastic foamed bodies 11, 12 or foamed body 13 (or silk cotton bodies/body) into the shell-shaped cup or breast pad, the tough sac 21 of the stuffed pressure-resistant bag 2 filled with the filling 22 can be pre-inserted into the forming cup 1, so that the sac 21, which is relatively soft and does not have a fixed shape, can be fixed in a preferred shape. The problem of short useful life resulting from elastic fatigue, deformation, aging, and flattening out associated with breast pads formed solely from PU foam material as in the prior art can be eliminated. The present invention is easy to manufacture and, after formation, forms a supporting portion 23 that can maintain the shape thereof after prolonged use, can resist damage, and has a nice feel. Besides, it has a longer useful life, can effectively help fix the shape of the wearer's breast, and can enable the wearer's breast to appear voluptuous and firm.

Figure 4:
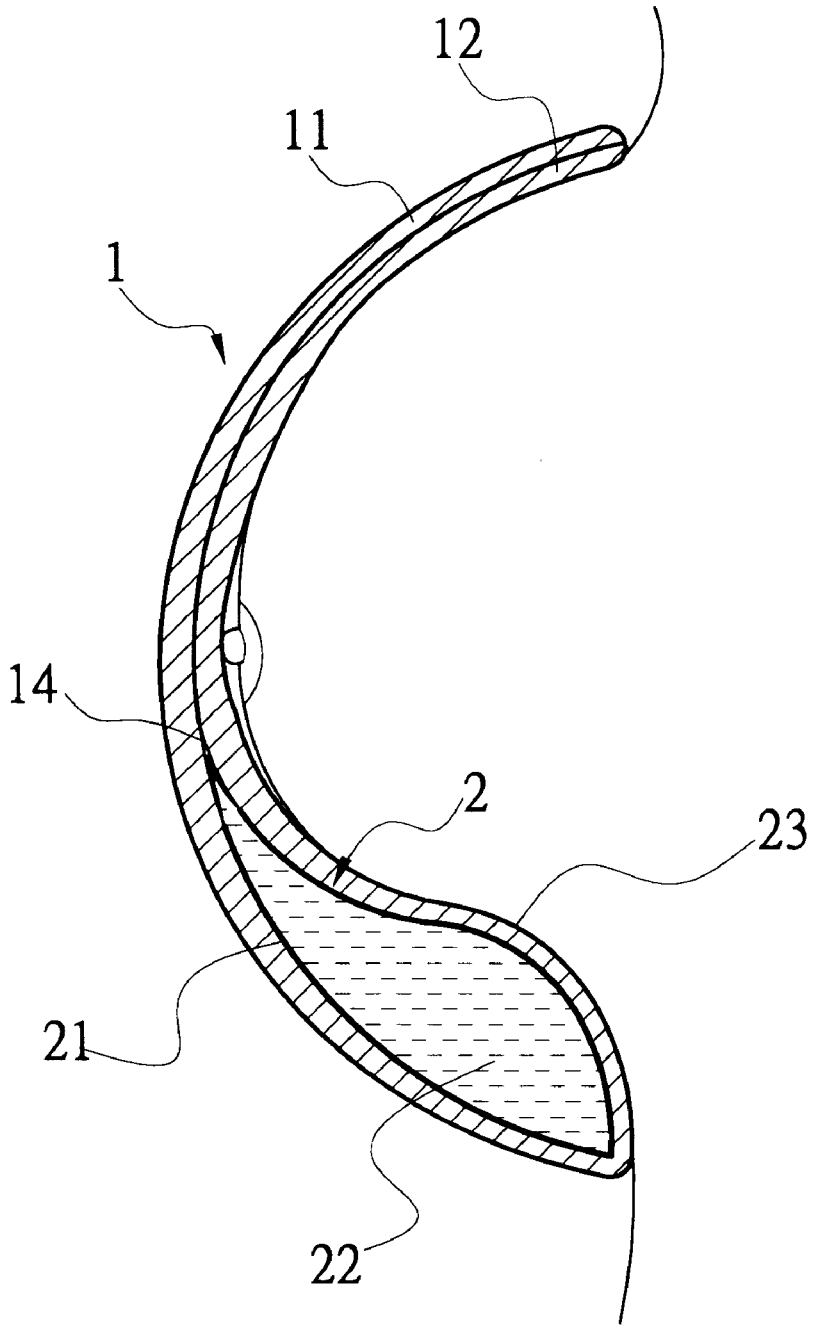
FIG. 4 is a schematic view of the present invention in a state of use.
Figure 5:
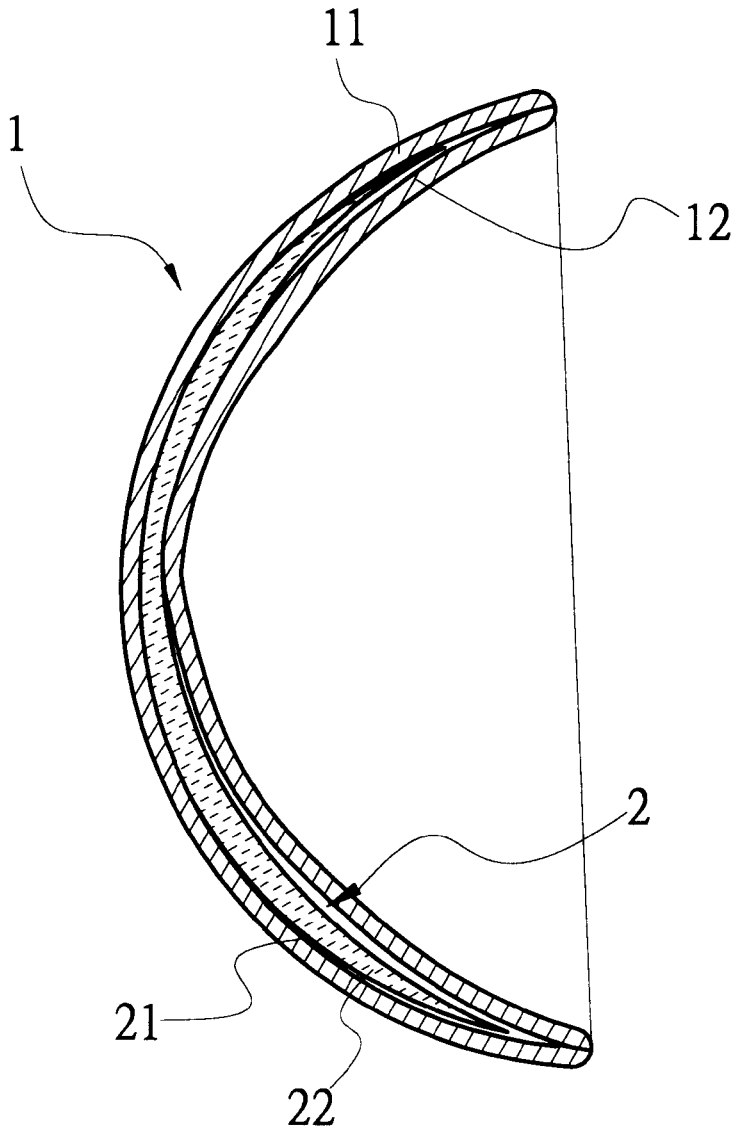
FIG. 5 is an assembled plan view of another preferred embodiment of the present invention.
Figure 6:
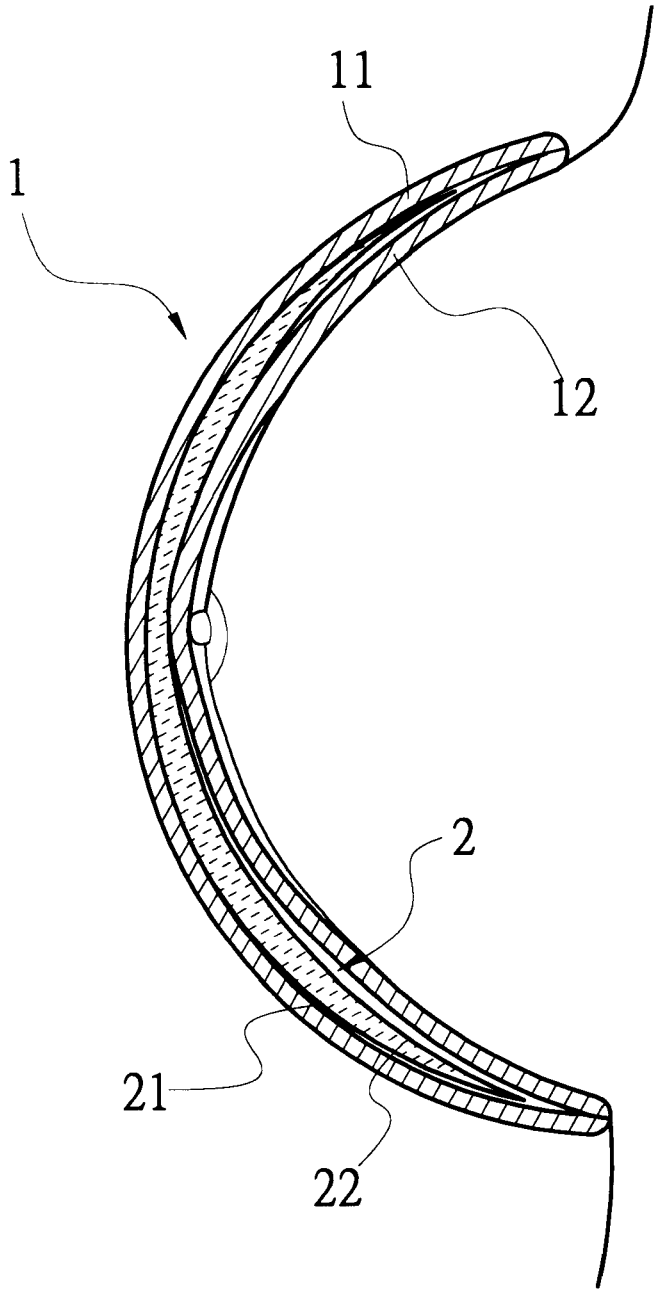
FIG. 6 is a schematic view of the preferred embodiment of FIG. 5 in a state of use.

With reference to FIGS. 2 and 4, in practice, the stuffed pressure-resistant bag 2 may be eye-shaped and, after assembly, is located in the lower half or outer side of the forming cup 1, with a suitable amount of the above-mentioned filling 22 stuffed inside. In this way, the wearer's breasts can be made to look firm and voluptuous. With reference to FIGS. 5 and 6, in practice, the stuffed pressure-resistant bag 2 can be enlarged to have any shape that is able to receive the receiving space 14 of the forming cup 1 so that, after assembly, the sac 21 can encompass the interior of the entire forming cup 1. The sac 21 contains a suitable amount of the above-mentioned filling 22. In use, the present invention can achieve the effect of making the wearer's breasts look larger. The receiving space 14 of the forming cup 1 and the sac 21 can have different arrangements in order to meet the demands of different wearers.

Figure 7:
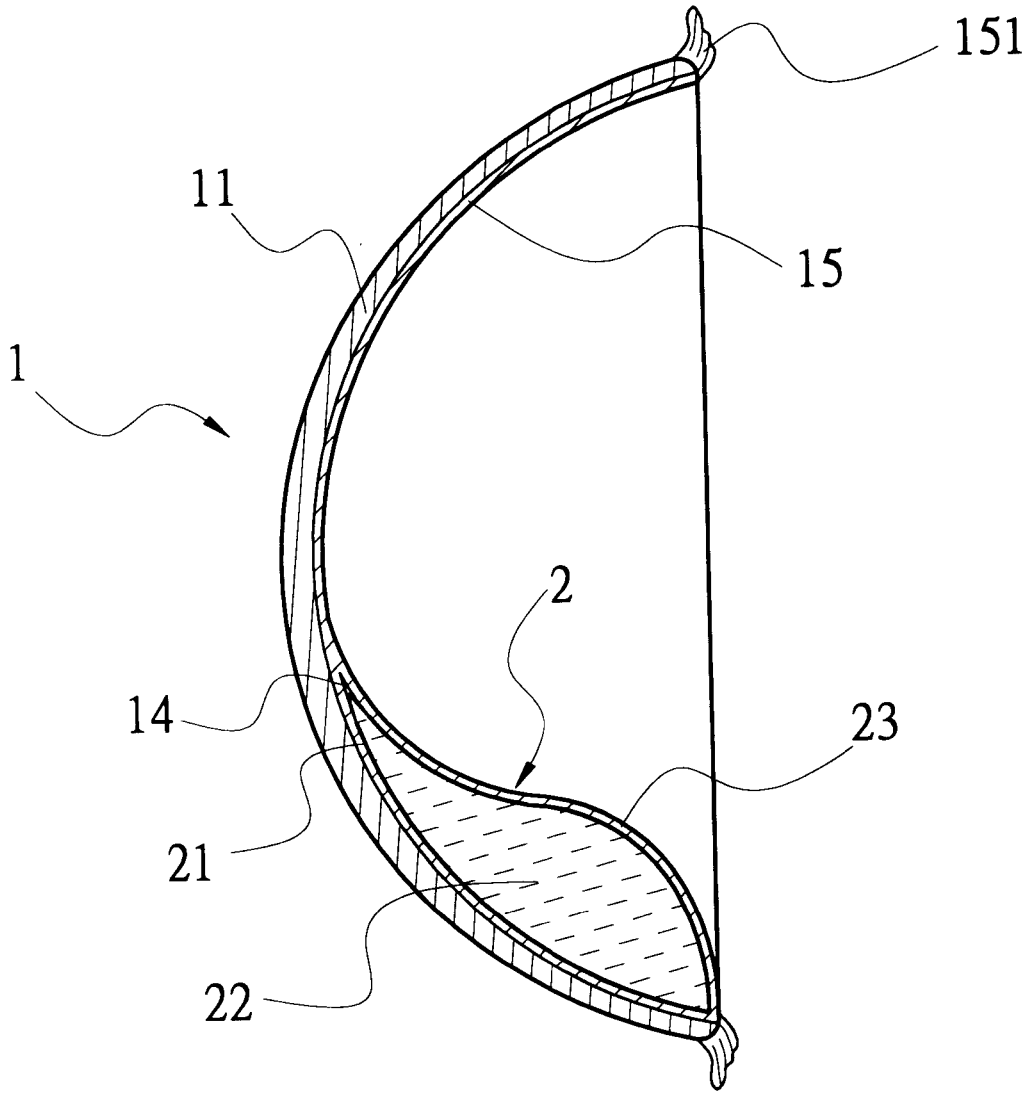
FIG. 7 is an assembled plan view of a forming cup formed from a foamed material and a fabric connected therewith.

With reference to FIG. 7, in order to enhance the appearance of the present invention and to save materials, the forming cup 1 of the present invention may, in practice, formed from the shell-like foamed body 11 and a layer of fabric 15 connected together. The advantage is that the forming cup 1 can be formed in a simplified manner. The outer surface can also have a decorative fabric 151 attached thereto so that the present invention has a nicer appearance.

Although the present invention has been illustrated and described with reference to the preferred embodiment thereof, it should be understood that it is in no way limited to the details of such embodiment but is capable of numerous modifications within the scope of the appended claims.

What is claimed is:

1. A breast pad structure which is configured to fit around a breast to improve the shape thereof, comprising:

a forming cup that has a shell shape curving inwardly in a single direction, and that is internally provided with a receiving space; and a sealed stuffed pressure-resistant bag containing therein a fluid or semi-fluid filling and positioned in said receiving space of said forming cup;

whereby said stuffed pressure-resistant bag, by means of the support of said forming cup, forms a contoured breast pad and, after formation, constitutes a supporting portion that resists deformation, damage and has a real feel, and thereby prolongs useful life and effectively makes the user's breasts comfortable and beautiful and firm.

2. A breast pad structure as defined in claim 1, wherein said forming cup is an integrally formed foam body formed from a PU foam material or silk cotton.

3. A breast pad structure as defined in claim 1, wherein said forming cup is two interconnected foamed bodies formed from a PU material or silk cotton.

4. A breast pad structure as defined in claim 1, wherein said forming cup includes a shell-shaped foamed body of PU foam or silk cotton and a layer of fabric connected therewith.

5. A breast pad structure as defined in claim 1, wherein said stuffed pressure-resistant bag is an eye-shaped bag and is located in a lower half portion or an outer side of said forming cup after assembly.

6. A breast pad structure as defined in claim 1, wherein said stuffed pressure-resistant bag is of any shape and is adapted for insertion into said receiving space of said forming cup, and fills the interior of said forming cup after assembly.

* * * * *